US011430589B2

(12) United States Patent
Hwang et al.

(10) Patent No.: US 11,430,589 B2
(45) Date of Patent: Aug. 30, 2022

(54) HYBRID MAGNET STRUCTURE

(71) Applicant: Advanced Ion Beam Technology, Inc., Hsin-Chu (TW)

(72) Inventors: Ching-Shiang Hwang, Hsinchu (TW); Jyh-Chyuan Jan, Hsinchu (TW); Hui-Huang Chen, Hsinchu (TW); Yun-Liang Chu, Hsinchu (TW)

(73) Assignee: ADVANCED ION BEAM TECHNOLOGY, INC., Hsin-Chu (TW)

( * ) Notice: Subject to any disclaimer, the term of this patent is extended or adjusted under 35 U.S.C. 154(b) by 0 days.

(21) Appl. No.: 17/350,484

(22) Filed: Jun. 17, 2021

(65) Prior Publication Data

US 2021/0398722 A1 Dec. 23, 2021

(30) Foreign Application Priority Data

Jun. 17, 2020 (TW) ..... 109120484
May 13, 2021 (TW) ..... 110117376

(51) Int. Cl.
*H01F 7/02* (2006.01)

(52) U.S. Cl.
CPC ..... *H01F 7/0278* (2013.01)

(58) Field of Classification Search
CPC ..... H01F 7/0278; H01J 37/1475
See application file for complete search history.

(56) References Cited

U.S. PATENT DOCUMENTS 3,768,054 A * 10/1973 Neugebauer ..... H02K 1/17 335/304

FOREIGN PATENT DOCUMENTS

EP 1246513 A2 * 10/2002 ..... H05H 7/04

* cited by examiner

*Primary Examiner* — Mohamad A Musleh
(74) *Attorney, Agent, or Firm* — WPAT, PC

(57) ABSTRACT

The disclosure provides a hybrid magnet structure which includes two dipole magnets assemblies arranged oppositely, and each dipole magnet assembly includes a permanent magnet, two iron cores, and a moveable magnetic field shunt element. The hybrid magnet structure is adapted to focus particle beams of different positions by applying an adjustable gradient magnetic field in the horizontal or vertical direction of the particle beam. By passing the charged particle beams through the gradient magnetic field established between the two dipole magnets, the aspect of focusing the charged particle beam is achieved. In addition, the intensity of the gradient magnetic field can be altered by adjusting the gap between the movable magnetic field shunt element and the permanent magnet, thereby controlling the particle beam size on a specific axis for different energies or masses of the charge particles.

9 Claims, 8 Drawing Sheets

HYBRID MAGNET STRUCTURE

FIELD OF THE DISCLOSURE

The present disclosure relates to a hybrid magnet structure, and in particular, to a hybrid magnet structure for the field of ion distribution technology.

BACKGROUND OF THE DISCLOSURE

Currently, in the field of ion distribution technology, the Dipole magnet and Quadrupole magnet (composed of two dipole magnets) are manufactured by winding coils around a stirrup, through which a gradient magnetic field is formed between the two dipole magnets and through which charged particle beams (e.g., ion beams) are converged (focused) in a specific axis, as described in Taiwan Patent Nos. TW I679669 and TW I640999.

This gradient field has the characteristic that the magnetic field at the center of the field is zero and the magnitude of the magnetic field increases in one axis (e.g., Y-axis direction) as it moves away from the center of the field. In this way, the charged particles at the center of the charged beam will experience zero magnetic field and can proceed in their original path. The magnetic field of the charged particle at the center of the charged particle beam in the Y-axis direction is not zero, and the magnetic field of the charged particle at the center of the charged particle beam is not zero. The magnetic force exerted by the magnetic field on the charged particles will drive them closer to the center of the charged particle beam (the center of the field), thus achieving the purpose of converging (focusing) the charged particle beam.

Conventional quadrupole magnets are designed to focus the charged particle beam passing through the field by varying the gradient field through the coil current. This method of controlling the gradient field through the coil current involves the following problems: (1) additional power is consumed, which increases the carbon footprint of the processed product and also increases the processing cost; (2) the magnetic field leakage is large, which tends to affect the magnetic field strength of the neighboring magnets; (3) the coil insulation material releases gas when it overheats, which affects or contaminates the vacuum chamber; and (4) the degree of magnetic field change is limited.

SUMMARY OF THE DISCLOSURE

It is therefore an object of the present disclosure to propose a hybrid magnet structure for focusing a charged particle beam moving in the z-axis direction, consisting of a first dipole magnet assembly and a second dipole magnet assembly in a co-planar configuration.

Another aspect of the present disclosure is to provide a first bipolar magnet assembly that includes a first permanent magnet, a first iron core, a second iron core, and a first magnetic conductivity element. The first permanent magnet has a first N-pole, a first S-pole, a first inner surface and a first outer surface opposite the first inner surface. The first N-pole and the first S-pole are configured in the direction of the parallel X-axis. The first inner surface and the first outer surface are located between the first N-pole and the first S-pole, and the first inner surface is configured to face the motion path of the charged particle beam. The first iron core contains a first covering section and a first extension section connected therewith, the first covering section covering the first N-pole and the first extension section extending from the first covering section and protruding from the first inner surface. The second iron core has a second covering section and a second extension section connected thereto, with the second covering section covering the first S-pole end, and the second extension section extending from the second covering section and projecting from the first inner surface. The first magnetic conductive element is movably disposed on the first outer surface of the first permanent magnet.

According to the exemplary embodiment, the second dipole magnet assembly consists of a second permanent magnet, a third iron core, a fourth iron core, and a second magnetic conductivity element. The second permanent magnet has a second N-pole, a second S-pole, a second inner side, and a second outer side opposite the second inner side. The second N-pole and the second S-pole are configured in the other linear direction parallel to the X-axis. The second inner face and the second outer face are located between the second N-pole and the second S-pole, and the second inner face is configured to face the first inner face toward the path of motion of the charged particle beam and toward the first permanent magnet.

The third core has a third covering section and a third extension section connected thereto. Specifically, the third covering section covers the second S-pole, and the third extension section extends from the third covering section and protrudes from the second inner surface, with the third extension section and the first extension section configured in the direction of a line parallel to the Y-axis. The fourth core has a fourth covering section and a fourth extension section connected thereto, with the fourth covering section covering the second N-pole, the fourth extension section extending from the fourth covering section and projecting from the second inner surface. The third extension section and the first extension section are configured in an all-way direction parallel to the Y-axis.

The fourth extension section extends from the fourth coverage section and protrudes from the second inner surface, and the fourth extension section and the second extension section are configured in the other linear direction parallel to the Y-axis. The second magnetic conductive element is movably disposed on the second outer side of the second permanent magnet, and movable on the second outer surface of the second permanent magnet.

In the exemplary embodiment for the hybrid magnet structure, a gradient magnetic field is created between the first dipole magnet assembly and the second dipole magnet assembly. The movable first and second magnetic conductive elements act as magnetic field dividers. The movable first magnetic conductor and second magnetic conductor act as the magnetic field shunting elements by controlling the spacing between the first magnetic conductor and the first permanent magnet and between the second magnetic conductor and the second permanent magnet. By controlling the spacing between the first conductive element and the first permanent magnet and the spacing between the second conductive element and the second permanent magnet, the gradient field can be verified without the use of high energy-consuming coils. The gradient magnetic field can be adjusted without using high power consumption coils.

BRIEF DESCRIPTION OF THE DRAWINGS

Additional features and advantage of the present disclosure will be made apparent from the following detailed description of one or more exemplary embodiments with reference to the accompanying figures, which are given for illustrative purpose only, and thus are not limitative of the present disclosure, wherein.

DETAILED DESCRIPTION OF THE EXEMPLARY EMBODIMENTS

Exemplary embodiments according to the present disclosure will be described below with references to the accompanying figures. It should be understood that the figures are not depicted to scale. Also, examples of "up", "down", "forward" or "backward" are used only to illustrate their orientation in the embodiment or to facilitate the description of the relative relationship of the components relative to each other, and are not intended to limit any actual orientation. For the convenience of description, the component relationships and physical quantities of each embodiment in the disclosure are described using a right-angle coordinate system, whereby the direction of motion of the charged particle beam is defined in the Z-axis direction, and the two dipole magnets are co-planar and their N and S poles are located in the XY plane.

If not specifically defined, the term "spacing" in the embodiments means a distance between two components or between specific parts of two components.

Generally, charged particles are generated by passing the source gas into the plasma reaction chamber to then the plasma source gas is extracted through a slit-like extraction electrode. The desired charged particles (ions) are then extracted from the plasma source gas through a slit-like extraction electrode. Therefore, the cross-sectional shape of the charged particle beam is generally flat, i.e., in one axis more than the other. i.e. longer in one axis (hereinafter referred to as the long axis) and flatter in the other orthogonal axis (hereinafter referred to as the short axis). The cross-sectional shape of the charged particle beam is therefore generally flat. For the sake of illustration, the long-axis direction of the charged particle beam in this manual is defined as the Y-axis. The long-axis direction is defined as the Y-axis direction (or vertical direction), and the short-axis direction of the charged particle beam is defined as the X-axis direction (or horizontal direction).

Permanent magnets are components made of magnetic materials that have a persistent magnetic field. The magnetic field cannot be changed by controlling the electric current like the magnetic field of an electromagnet. The magnitude of the magnetic field cannot be changed by controlling the current as in the case of an electromagnet. Types of permanent magnets include ceramic, ferrite, or rare earth permanent magnets (e.g. SmCo).

Figure 1:
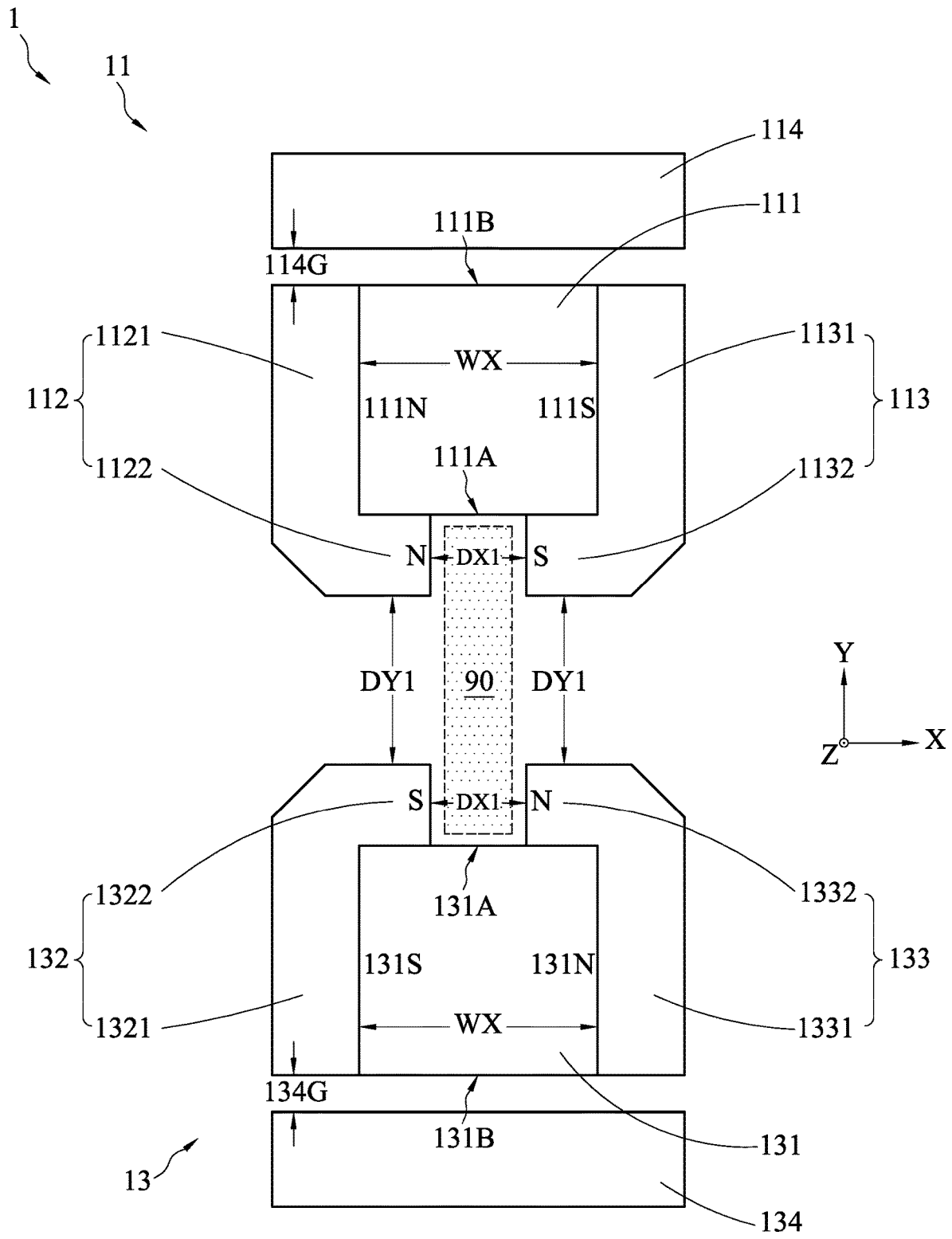
FIG. 1 is a schematic diagram of the first embodiment of the hybrid magnet structure of the present disclosure.

Referring to FIG. 1, a first embodiment of the hybrid magnet structure of the present disclosure is illustrated. A hybrid magnet structure 1 is a quadrupole magnet consisting mainly of two secondary magnets in the XY plane in a coplanar configuration, namely the first dipole magnet assembly 11 and the second dipole magnet assembly 13. The hybrid magnet structure 1 is used to focus the charged particle beam 90 moving in the Z-axis direction. The cross-section of the charged particle beam 90 is generally flat as shown in FIG. 1, whereby the long axis direction is the Y-axis direction (vertical direction) and the short axis direction is the X-axis direction (horizontal direction). The hybrid magnet structure 1 is configured in FIG. 1 to focus the charged particle beam 90 in the long-axis direction. In other words, after the charged particle beam 90 passes through the hybrid magnet structure 1, the length of the cross-section along the Y-axis will be shortened, and the length along the X-axis will be slightly longer. The principle of using a quadrupole magnet to focus a charged particle beam has been described in numerous conventional technical papers, and will not be described here. The focus of the present disclosure involves a newly designed hybrid magnet structure to replace the conventional quadrupole magnet using coils to control the magnetic field of the magnetic poles.

As shown in FIG. 1, the first dipole magnet assembly 11 contains a first permanent magnet 111, which has a first N-pole 111N and a first S-pole 111S, as well as a first inner side 111A and a first outer side 111B opposite the first inner side 111A. The first N-pole 111N and the first S-pole 111S are configured on the first inner side 111A and the first outer side 111B opposite the first inner side 111A, and in the direction parallel to the X-axis. The first inner surface 111A and the first outer surface 111B are located between the first N-terminal 111N and the first S-terminal 111S, and the first inner surface 111A is configured to face the motion path of the charged particle beam 90.

The first dipole magnet assembly 11 further includes a first iron core 112, which has a first covering section 1121 and first extension section 1122 connected therewith. The first covering section 1121 covers the end face of the first N-terminal 111N so as to minimize the emission from the first N-terminal 111N, and direct the magnetic lines ML emitted from the first N-terminal 111N as far as possible to the first extension section 1122. The first extension section 1122 is connected to one end of the first covering section 1121, and extends from the first covering section 1121 and protrudes from the first inner surface 111A. The magnetic lines ML of the first permanent magnet 111 are mainly emitted from the first extension section 1122, so that the first extension 1122 is used as the first inner surface 111A. Therefore, the first extension 1122 serves as one of the magnetic poles of the first dipole magnet assembly 11.

The first dipole magnet assembly 11 further includes a second iron core 113 that has a second covering section 1131 and a second extension section 1132 connected thereto, wherein the second covering section 1131 covers the end face of the first S-pole 111S to direct the magnetic lines ML of the magnetic field emitted from the first extension section 1122 to the first S-pole 111S as far as possible. After the magnetic lines ML of the magnetic field of the first permanent magnet 111 are emitted from the first extension section 1122, a major portion is returned to the first permanent magnet 111 through the second extension section 1132, so that the second extension section 1132 serves as another magnetic pole of the first dipole magnet assembly 11. The second extension section 1132 is therefore used as another pole of the first dipole magnet assembly 11.

Figure 2A:
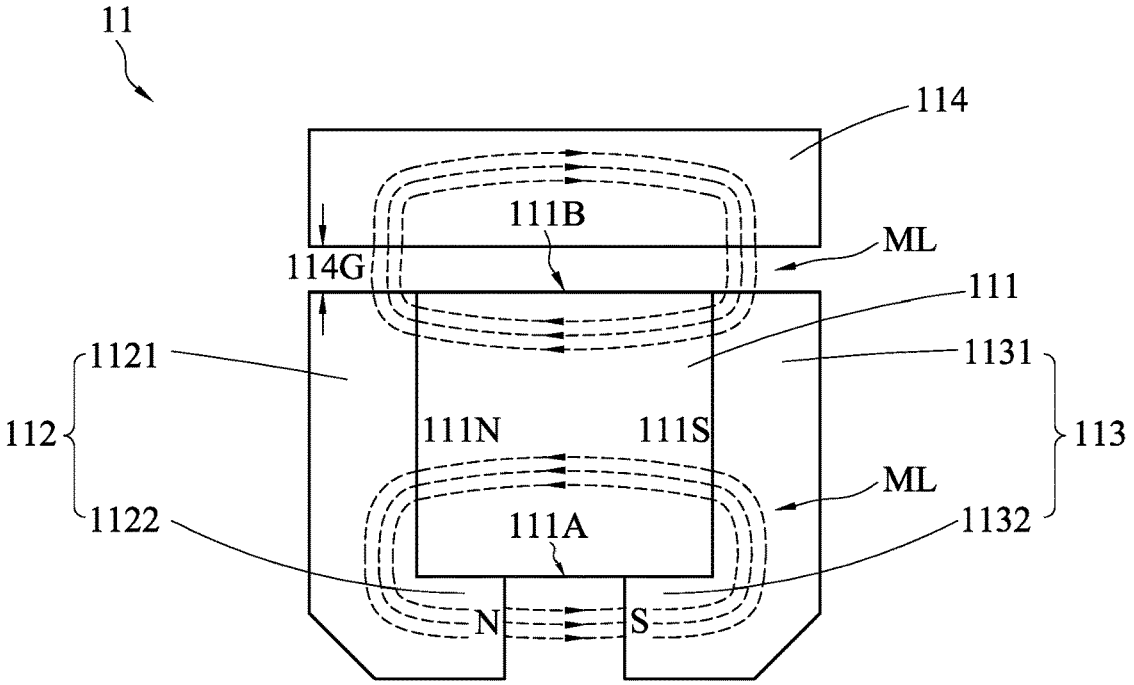
FIG. 2A illustrates the distribution of magnetic lines of the first embodiment when the first magnetic conductive element is close to the first permanent magnet.
Figure 2B:
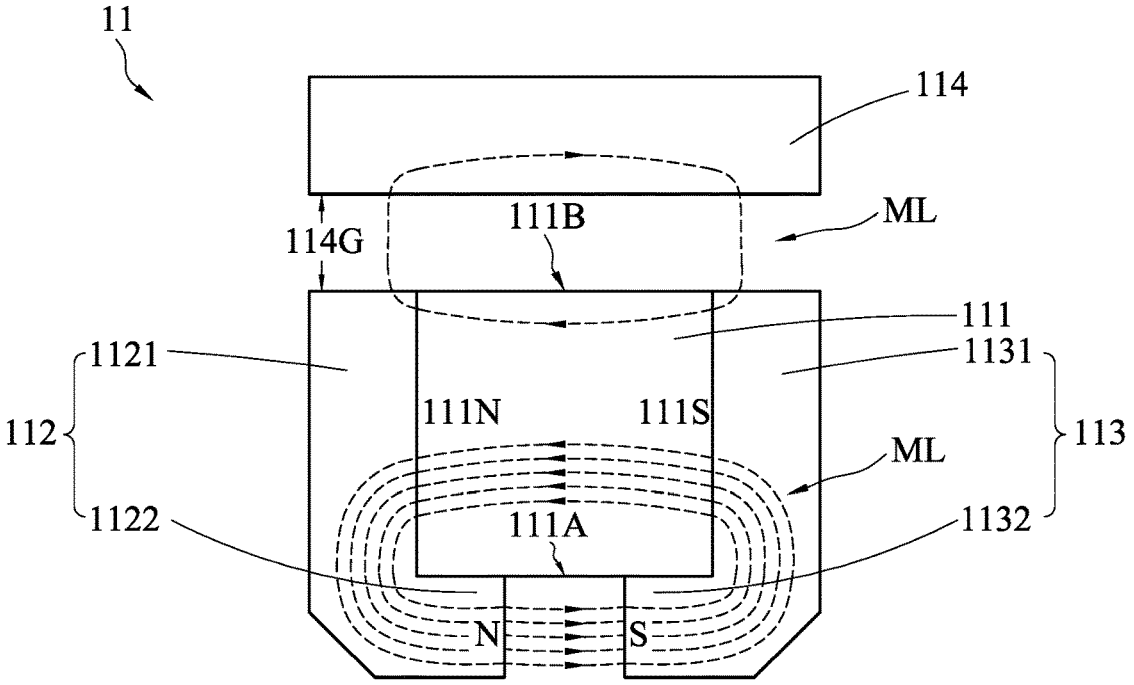
FIG. 2B illustrates the distribution of magnetic lines of the first embodiment when the first magnetic conductive element is far away from the first permanent magnet.

Referring to FIG. 1 and FIGS. 2A and 2B, the first dipole magnet assembly 11 has a first magnetic conductive element 114 movably disposed on the first outer surface 111B of the first permanent magnet 111. As shown in FIG. 2A, when the first magnetic conductor 114 is closer to the first outer surface 111B, i.e., the distance 114G between the first magnetic conductor 114 and the first outer surface 111B is smaller, the magnetic lines ML of the magnetic field to the first magnetic conductor 114 will be more, and consequently the magnetic field from the first extension section 1122 and back to the first permanent magnet 111 through the second extension section 1132 will be smaller. As shown in FIG. 2B, when the first magnetic conductive element 114 is further away from the first outer surface 111B, i.e., the distance 114G between the first magnetic conductive element 114 and the first outer surface 111B is larger, the magnetic lines ML of the magnetic field to the first magnetic conductive element 114 will be less, and the magnetic field from the first extension section 1122 and back to the first permanent magnet 111 through the second extension section 1132 will be larger. In this way, one can control the magnitude of the magnetic field applied to the charged particle beam 90 by the first dipole magnet assembly 11 by adjusting the spacing 114G between the first magnetic conductive element 114 and the first outer surface 111B of the first permanent magnet 111.

Referring to FIG. 1, the second dipole magnet assembly 13 consists of a second permanent magnet 131 having a second N-pole 131N and a second S-pole 131S, a second inner surface 131A and a second outer surface 131B opposite the second inner surface 131A. The second N-pole 131N and the second S-pole 131S are configured in the other linear direction parallel to the X-axis and differ from the configuration of the first N-pole 111N and the first S-pole 111S by 180 degrees. The second N-pole 131N and the second S-pole 131S are configured in the other direction parallel to the X-axis and are 180 degrees different from the configuration of the first N-pole 111N and the first S-pole 111S. The second inner surface 131A and the second outer surface 131B are located between the second N-pole 131N and the second S-pole 131S, and the second inner surface 131A is configured to face the first inner surface 111A toward the path of motion of the charged particle beam 90 and toward the first permanent magnet 111.

The second dipole magnet assembly 13 further includes a third core 132 consisting of a third covering section 1321 and a third extension section 1322 connected thereto, wherein the third covering section 1321 covers the end face of the second S-pole 131S to direct the magnetic lines ML of the magnetic field emitted from the third extension section 1322 to the second S-pole 131S as far as possible. The third extension section 1322 extends from the third covered section 1321 and projects from the second inner surface 131A, and the third extension section 1322 and the first extension section 1122 are configured in the parallel Y-axis direction and are separated from each other by a distance of a first vertical spacing DY1.

The second dipole magnet assembly 13 also has a fourth core 133 which is consisted of a fourth covering section 1331 and a fourth extension section 1332 connected thereto, wherein the fourth covering section 1331 covers the end face of the second N-pole 131N to direct the magnetic lines ML of the magnetic field emitted from the second N-pole 131N to the fourth extension section 1332 as far as possible. The fourth extension section 1332 and the second extension section 1132 are configured in the other linear direction parallel to the Y-axis and are separated from each other by the distance of the first vertical spacing DY1. The magnetic lines ML of the second permanent magnet 131 are mainly emitted from the fourth extension section 1332 and are guided by the third extension 1322 and the third extension 131. The magnetic lines of the second permanent magnet 131 are mainly emitted from the fourth extension 1332 and return to the second permanent magnet 131 through the third extension section 1322 and the third covering section 1321, so that the third extension section 1322 and the fourth extension section 1332 are the two poles of the second dipole magnet assembly 13.

Figure 3A:
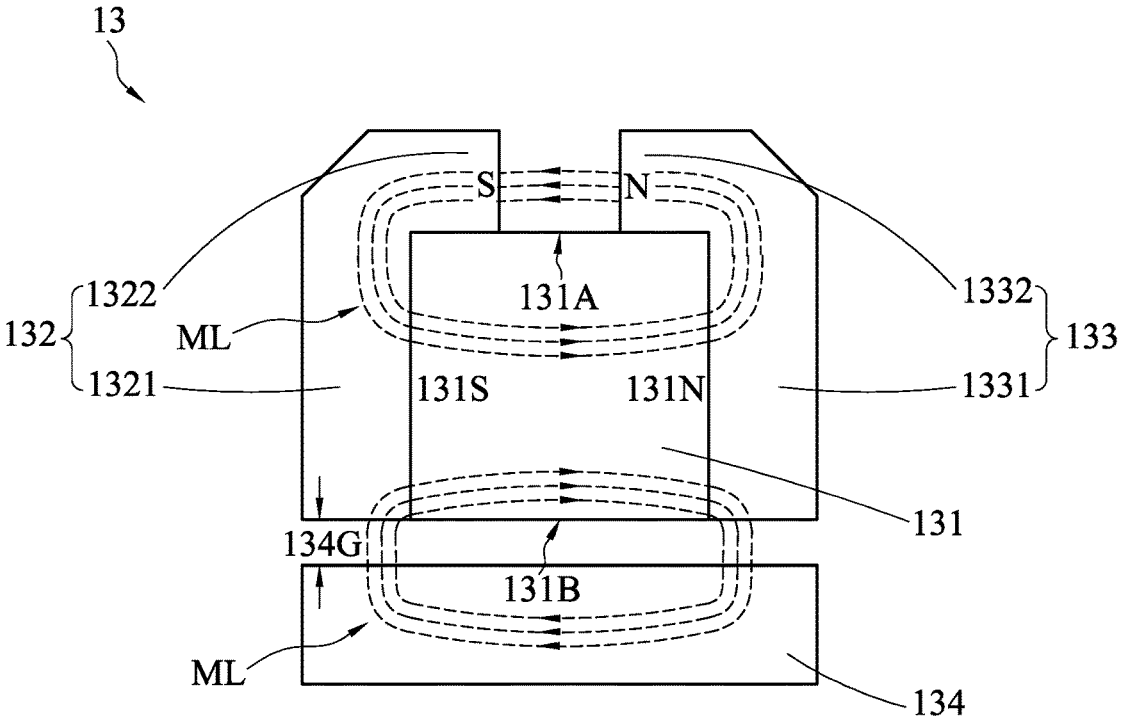
FIG. 3A illustrates the distribution of magnetic lines when the second magnetic conductive element of the first embodiment is close to the second permanent magnet.
Figure 3B:
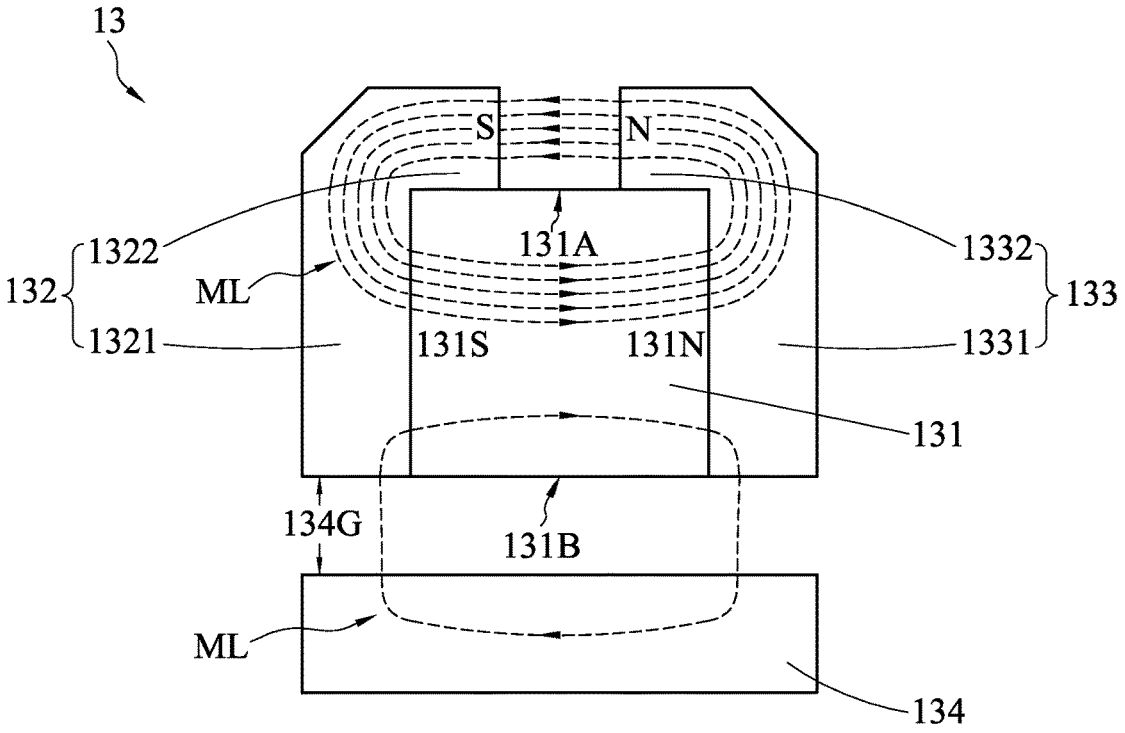
FIG. 3B illustrates the magnetic lines of the first embodiment when the second magnetic conductive element is far away from the second permanent magnet.

Referring to FIG. 1 and FIGS. 3A and 3B, the second dipole magnet assembly 13 also contains a second magnetic conductive element 134 movably disposed on the second outer surface 131B of the second permanent magnet 131. The second magnetic conductive element 134 serves a similar function as the first magnetic conductive element 114. As shown in FIG. 3A, when the second magnetic conductor 134 is closer to the second outer surface 131B, i.e., the gap 134G between the second magnetic conductor 134 and the second outer surface 131B is smaller, the magnetic force shifted to the second magnetic conductor 134 will be more than the magnetic force shifted to the second magnetic conductor 134. The magnetic lines ML of the magnetic field to the second magnetic conductive element 134 will be more, which in turn will result in a smaller amount of magnetic field emitted from the fourth extension section 1332 and returned to the second permanent magnet 131 through the third extension section 1322. As shown in FIG. 3B, when the second magnetic conductive element 134 is farther away from the second outer surface 131B, i.e., the gap 134G between the second magnetic conductive element 134 and the second outer surface 131B is larger, the magnetic lines ML of the magnetic field to the second magnetic conductive element 134 will be less, which in turn will result in a larger magnetic field from the fourth extension section 1332 back to the second permanent magnet 131 through the third extension section 1322. In this way, one can control the magnitude of the magnetic field applied to the charged particle beam 90 by the second dipole magnet assembly 13 by adjusting the gap 134G between the second magnetic conductive element 134 and the second outer surface 131B of the second permanent magnet 131.

In practice, some of the magnetic lines from the first extension section 1122 may also enter the third extension section 1322, and some of the magnetic lines from the fourth extension section 1332 may also enter the second extension section 1132, but since the length of the long axis of the charged particle beam 90 is often much larger than the length of the short axis, and the size of the first vertical spacing DY1 will also be much larger than that of the first horizontal spacing DX1. Therefore, the proportion of magnetic lines from the first extension section 1122 entering the third extension section 1322 or the proportion of magnetic lines from the fourth extension section 1332 entering the second extension section 1132 is very limited.

Figure 4A:
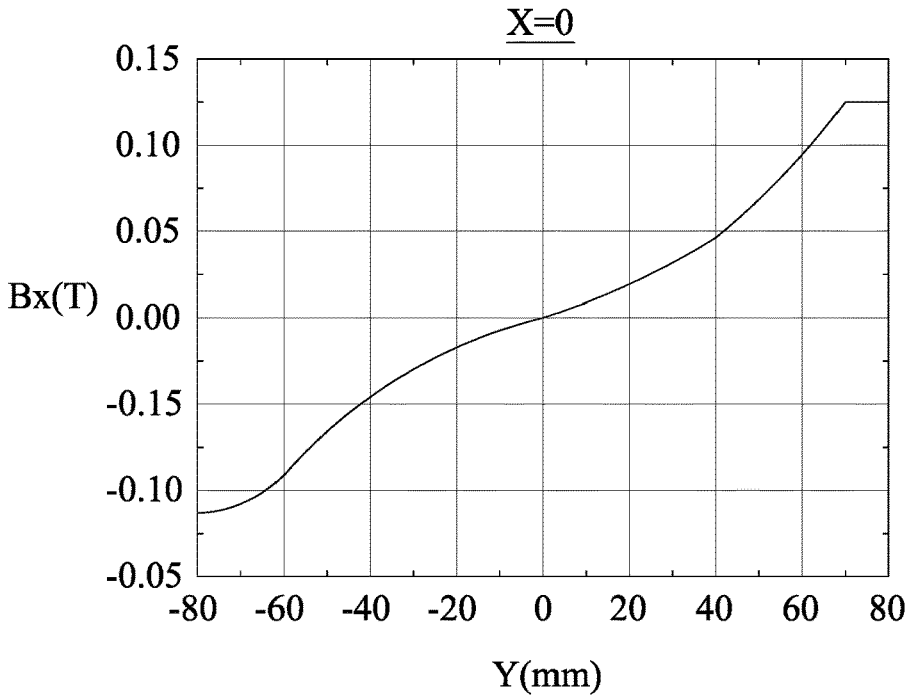
FIG. 4A illustrates a simulation of the gradient magnetic field formed by the hybrid magnet structure of the first embodiment, with the center coordinates of the gradient field at (0,0), and the curve represents the trend of the magnetic field Bx at X=0 with Y-axis.
Figure 4B:
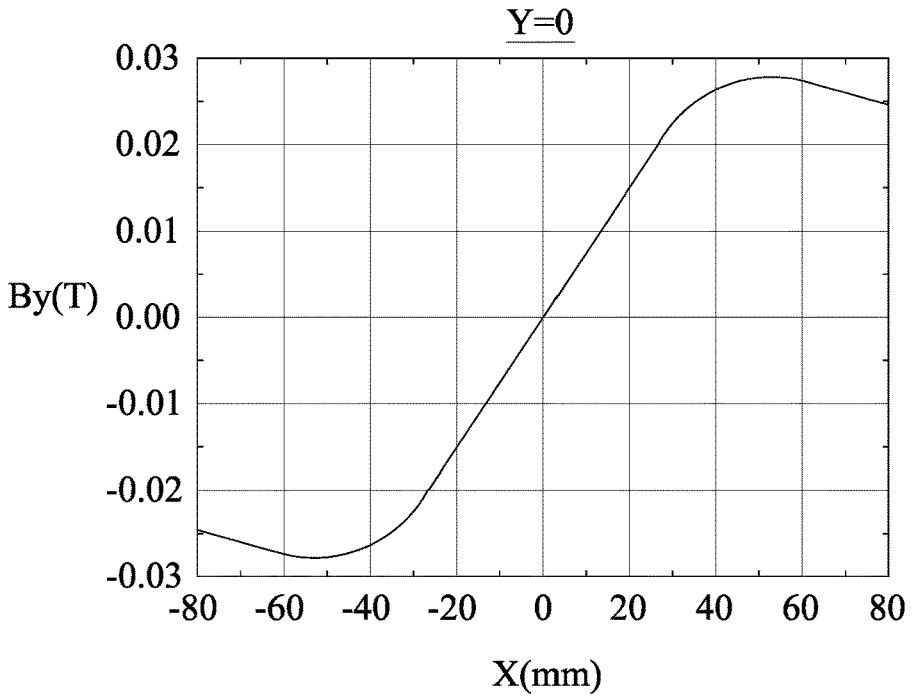
FIG. 4B illustrates a simulation of the gradient magnetic field formed by the hybrid magnet structure of the first embodiment, with the center coordinates of the gradient field at (0,0), and the curve represents the trend of the magnetic field By at Y=0 with X-axis.

Referring to FIGS. 4A and 4B, they are schematic diagrams of the simulation of the gradient magnetic field formed by the hybrid magnet structure 1 in which the gradient magnetic field is located on the XY plane, and the coordinates of the center of the gradient magnetic field are (0, 0). Specifically, FIG. 4A illustrates the curve of the magnetic field Bx with the X axis at Y=0. One can see from FIGS. 4A and 4B that the magnetic field in the center of the gradient magnetic field is 0, and that the magnetic field will gradually increase as it moves away from the center of the gradient magnetic field.

As one can expect, if the cross-section of the charged particle beam 90 in FIG. 1 is rotated by 90 degrees, i.e., the long axis is in the X-axis direction (horizontal direction) and the short axis is in the Y-axis direction (vertical direction), then the hybrid magnet structure 1 of FIG. 1 can also be used to focus it in the X-axis direction by rotating it by 90 degrees.

As shown in FIG. 1, the distance between the first extension section 1122 of the first iron core 112 and the third extension section 1322 of the third core 132 along the Y-axis is equal to the distance between the second extension section 1132 of the second iron core 113 and the fourth extension section 1332 of the fourth core 133 along the Y-axis, and both are of the same first vertical spacing DY1. In addition, the distance between the first extension section 1122 of the first iron core 112 and the second extension section 1132 of the second iron core 113 along the X-axis direction is equal to the distance between the third extension section 1322 of the third core 132 and the fourth extension section 1332 of the fourth core 133 along the X-axis direction, and both are of the same first horizontal spacing DX1. In the present embodiment, the hybrid magnet structure 1 is used to converge (focus) the charged particle beam 90 in the long-axis direction of the Y-axis, and therefore the first vertical spacing DY1 is larger than the first horizontal spacing DX1. Also, the first horizontal spacing DX1 is smaller than the width WX, i.e., the first extension section 1122 and second extension section 1132 are extended inward, and the third extension section 1322 and the fourth extension section 1332 are also extended inward.

As mentioned above, when the long-axis direction of the charged particle beam is in the X-axis direction (horizontal direction), the hybrid magnet structure 1 of the first embodiment can be used to focus the charged particle beam in the X-axis direction by rotating it by 90 degrees. However, in some cases, due to the space constraints of the device or the configuration and alignment of the components, the quadrupole magnets may only be allowed in a single axial direction (e.g., vertical direction). The second embodiment of the present disclosure therefore allows for the focusing of the charged particle beam in the X-axis direction while maintaining the relative spatial configuration of the two magnet assemblies as in the first embodiment.

Figure 5:
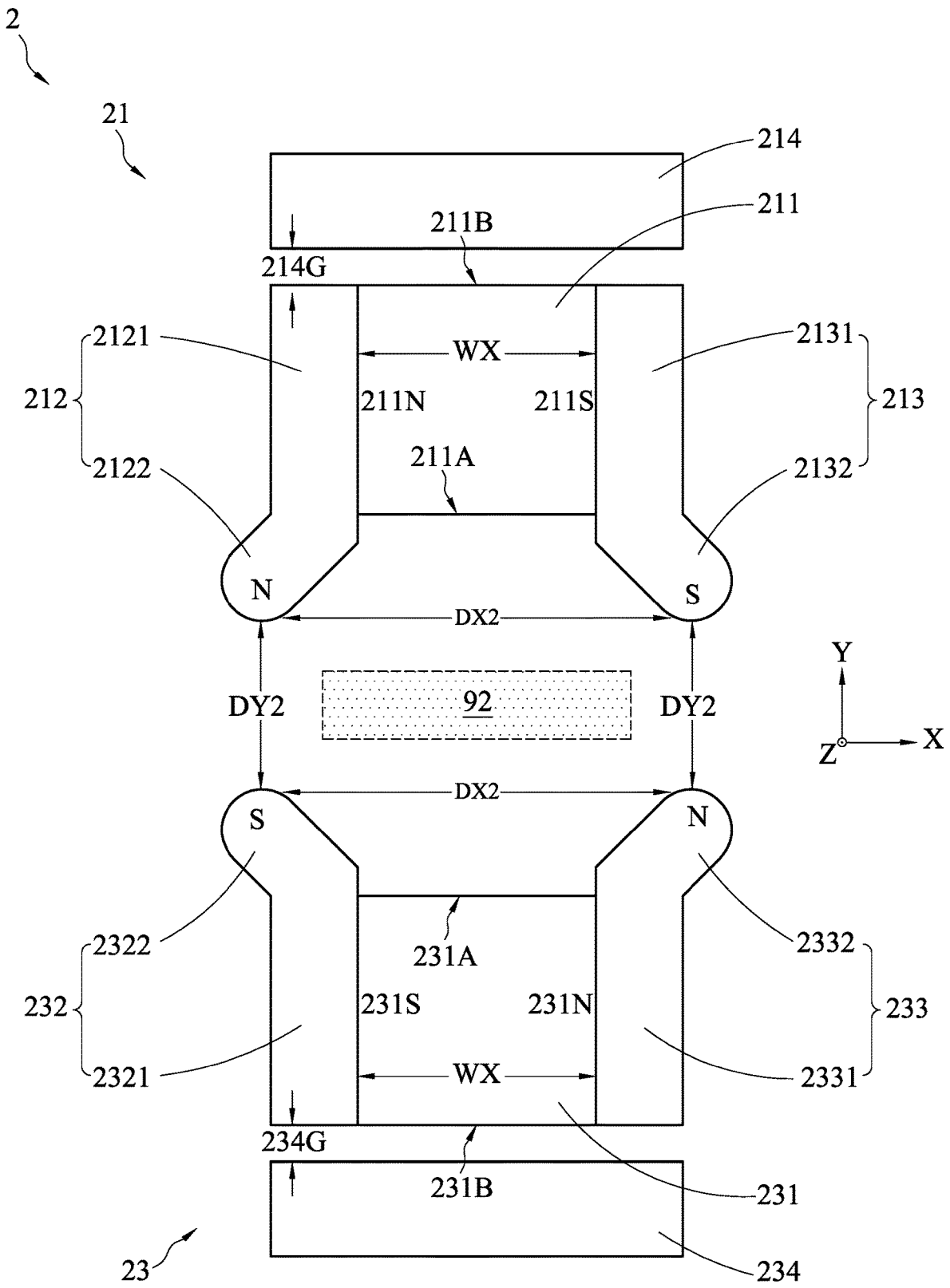
FIG. 5 is a schematic diagram of the second embodiment of the hybrid magnet structure of the present disclosure.

A second embodiment of the hybrid magnet structure of the present disclosure is shown in FIG. 5, which illustrates another configuration through a hybrid magnet structure 2. The hybrid magnet structure 2 mainly contains two secondary magnets, a first dipole magnet assembly 21 and a second dipole magnet assembly 23, configured in the XY plane in a coplanar manner. The cross-section of the charged particle beam 92 is flat as shown in FIG. 5, whereby the long axis is in the X-axis direction (horizontal direction) and the short axis is in the Y-axis direction (vertical direction). The hybrid magnet structure 2 configured in the manner of FIG. 5 is used to focus the charged particle beam 92 in the horizontal direction, i.e., the cross-section of the charged particle beam 92 becomes shorter along the X-axis and slightly longer along the Y-axis after passing through the hybrid magnet structure 2.

As shown in FIG. 5, the first dipole magnet assembly 21 has a first permanent magnet 211 with a first N-pole 211N, a first S-pole 211S, a first inner side 211A, and a first outer side 211B opposite the first inner side 211A. The first N-pole 211N and the first S-pole 211S are configured in the direction of an axis parallel to the X-axis. The first inner surface 211A and the first outer surface 211B are located between the first N-pole 211N and the first S-pole 211S, and the first inner surface 211A is configured to face the motion path of the charged particle beam 92.

Referring to FIG. 5, the second dipole magnet assembly 23 includes a second permanent magnet 231 with section 2321 extending and projecting from the second inner surface 231A, and a third extension section 2322 and a first extension section of the second permanent magnet 231 having a second N-terminal 231N and a second S-terminal 231S, a second inner surface 231A and a second outer surface 231B opposite the second inner surface 231A. The second N-pole 231N and the second S-pole 231S are configured in the other linear direction parallel to the X-axis and are 180 degrees different from the configuration of the first N-pole 211N and the first S-pole 211S. The second inner surface 231A and the second outer surface 231B are located between the second N-pole 231N and the second S-pole 231S, and the second inner surface 231A is configured to face the charged particle beam 92. The second inner side 231A is configured to face the first inner side of the first permanent magnet 211 towards the motion path of the charged particle beam 92 and towards the first inner side of the first permanent magnet 211A.

The first dipole magnet assembly 21 further includes a first iron core 212, which has a first covering section 2121 and a first extension section 2122 connected thereto, wherein the first covering section 2121 covers the end face of the first N-pole 211N to direct the magnetic lines of force ML emitted from the first N-pole 211N to the first extension section 2122 as far as possible. The first extension section 2122 is connected to one end of the first covering section 2121 and extends from the first covering section 2121 and protrudes from the first inner side surface 211A. The magnetic lines ML of magnetic field of the first permanent magnet 211 are mainly emitted from the first extension section 2122, so that the first extension section 2122 is one of the poles of the first dipole magnet assembly 21. Unlike the first extension section 1122 of the first embodiment, which extends inwardly after projecting from the first inner surface 111A, the first extension section 2122 of this embodiment extends outwardly after projecting from the first inner surface 211A.

The second dipole magnet assembly 23 further includes a third core 232, which has a third covering section 2321 and a third extension section 2322 connected thereto, wherein the third covering section 2321 covers the end face of the second S-pole 231S to direct the magnetic lines ML emitted from the first extension section 2122 to the third extension section 2322 as far as possible. Unlike the first embodiment where the third extension section 1322 extends inwardly, the third extension section 2322 in this embodiment extends inwardly after projecting from the second inner surface 231A. The third extension section 2322 of this embodiment extends toward the exterior after projecting from the second interior surface 231A.

The first dipole magnet assembly 21 also contains a second iron core 213, which has a second covering section 2131 and a second extension section 2132 connected thereto, wherein the second covering section 2131 covers the end face of the first S-pole 211S to direct the magnetic lines of force emitted from the second permanent magnet 231 of the second dipole magnet assembly 23 to the second extension section 2132 as far as possible. The second extension section 2132 is connected to one end of the second covering section 2131 and extends from the second covering section 2131 to project out of the first inner surface 211A. Unlike the first embodiment where the second extension section 1132 extends inwardly after projecting from the first inner surface 111A, the second extension section 2132 of this embodiment extends outwardly after projecting from the first inner surface 211A. In addition, in this embodiment, the first permanent magnet 211 has a width WX along the X-axis, and the first extension section 2122 and the second extension section 2132 have a second horizontal spacing DX2 along the X-axis, and the second horizontal spacing DX2 is larger than the width WX and a second vertical spacing DY2.

The second dipole magnet assembly 23 also contains a fourth core 233 which has a fourth covering section 2331 and a fourth extension section 2332 connected thereto, wherein the fourth covering section 2331 covers the end face of the second N-pole 231N to direct the magnetic lines ML emitted from the second N-pole 231N to the fourth extension section 2332 as far as possible. The fourth extension section 2332 and the second extension section 2132 are configured symmetrically opposite to each other in the XZ plane and separated from each other by a distance of the second vertical spacing DY2. Unlike the first embodiment in which the fourth extension section 1332 extends inwardly, the fourth extension section 2332 in this embodiment extends outwardly. In addition, in this embodiment, the second permanent magnet 231 has a width WX along the X-axis, and the third extension section 2322 and the fourth extension section 2332 have the second horizontal spacing DX2 along the X-axis, and the second horizontal spacing DX2 is larger than the width WX and the second vertical spacing DY2.

Figure 6:
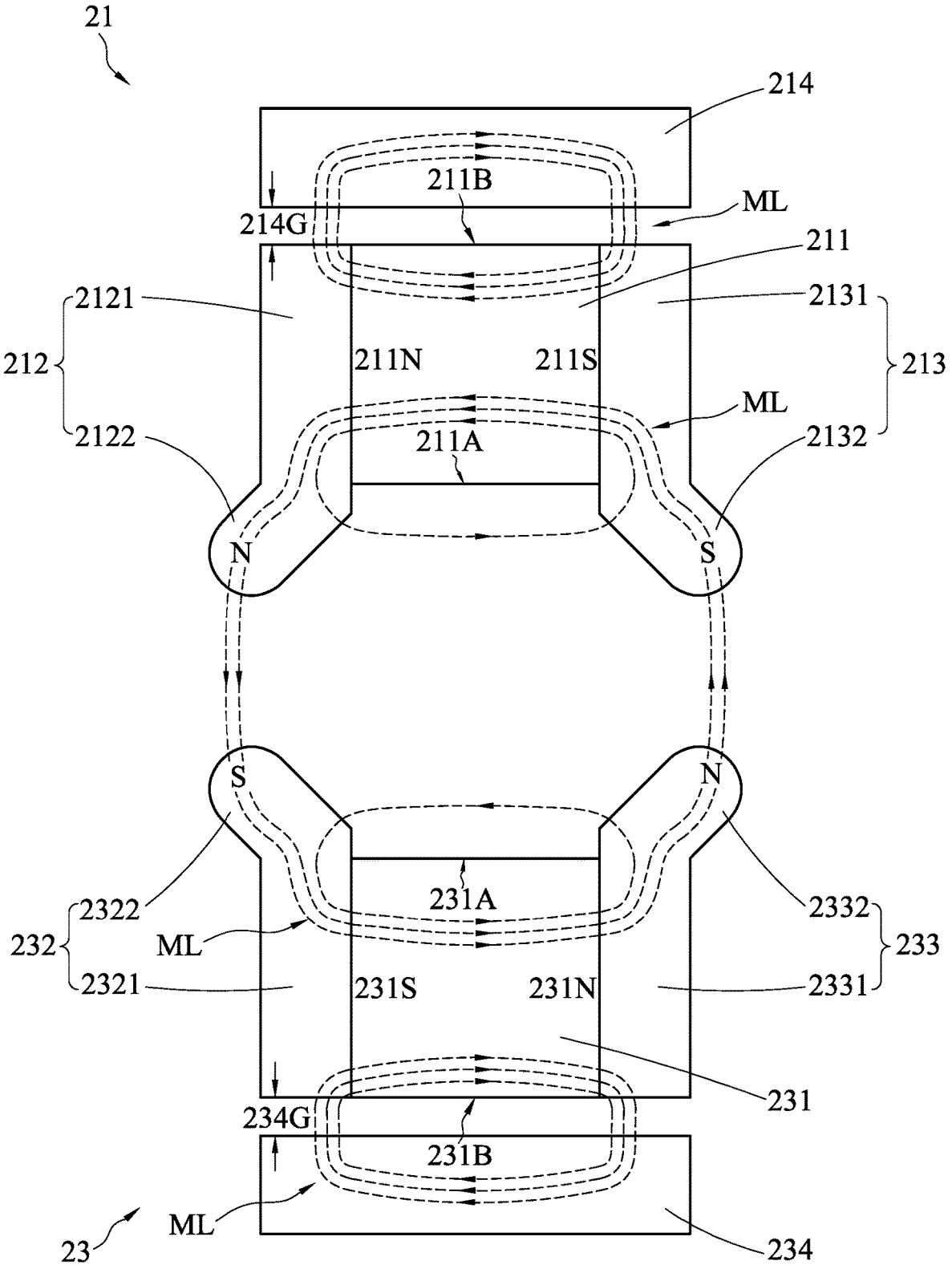
FIG. 6 illustrates the distribution of magnetic lines when the first magnetic conductive element is close to the first permanent magnet and the second magnetic conductive element is close to the second permanent magnet of the second embodiment.
Figure 7:
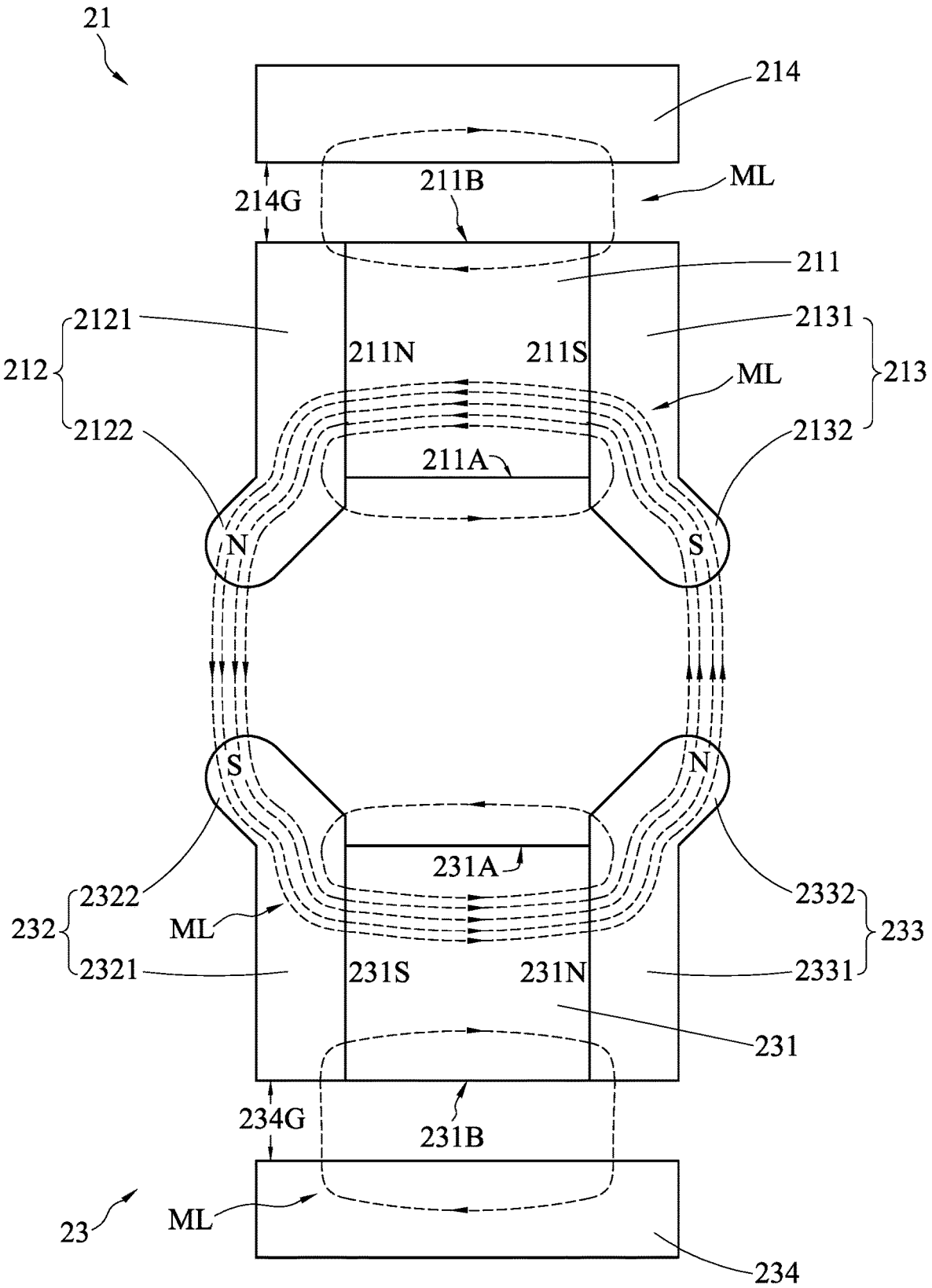
FIG. 7 illustrates the first magnetic conductive element of the second embodiment far away from the first permanent magnet and the second magnetic conductive element far away from the second permanent magnet.

Referring to FIGS. 5 to 7, the first dipole magnet assembly 21 includes a first magnetic conductive element 214 movably disposed on the first outer surface 211B of the first permanent magnet 211. As shown in FIG. 6, when the first magnetic conductor 214 is closer to the first outer surface 211B, i.e., the distance 214G between the first magnetic conductor 214 and the first outer surface 211B is smaller, the magnetic lines ML diverted to the first magnetic conductor 214 will be more shunted. The magnetic field to the first conductive element 214 will be larger, and consequently the magnetic field from the first extension section 2122 and through the third extension section 2322 will be smaller. As shown in FIG. 7, when the first magnetic conductive element 214 is farther away from the first outer surface 211B, i.e., the distance 214G between the first magnetic conductive element 214 and the first outer surface 211B is larger, the magnetic field shunted to the first magnetic conductive element 214 will be smaller.

When the distance 214G between the first magnetic conductive element 214 and the first outer surface 211B is larger, the magnetic lines ML of the magnetic field to the first magnetic conductive element 214 will be less, and the magnetic field from the first extension section 2122 and through the third extension section 2322 will be larger. In this way, one can control the magnitude of the magnetic field applied to the charged particle beam 92 by the first dipole magnet assembly 21 by adjusting the spacing 214G between the first guiding element 214 and the first outer surface 211B of the first permanent magnet 211.

Referring to FIGS. 5 to 7, the second conductive element 234 has a similar function to the first conductive element 214. In some configurations, the second magnetic conductive element 234 is made of an iron core material, so that a portion of the magnetic lines ML of the second permanent magnet 231 will be diverted to the second magnetic conductive element 234. The magnetic lines of force ML to the second magnetic conductive element 234 will be more, which in turn will cause the amount of magnetic field emitted from the fourth extension section 2332 and passing through the second extension section 2132 is smaller. As shown in FIG. 7, when the second magnetic conductor 234 is further away from the second outer surface 231B, i.e., the gap 234G between the second magnetic conductor 234 and the second outer surface 231B is larger, less magnetic lines ML will be diverted to the second magnetic conductor 234, which will result in a larger magnetic field from the fourth extension section 2332 and through the second extension section 2132. In this way, the engineer can control the magnitude of the magnetic field applied to the charged particle beam 92 by the second dipole magnet assembly 13 by adjusting the gap 234G between the second magnetic conductivity element 234 and the second outer surface 231B of the second permanent magnet 231.

As shown in FIGS. 6 and 7, in practice, some of the magnetic lines emitted from the first extension section 2122 may also enter the second extension section 2132, and some of the magnetic lines emitted from the fourth extension section 2332 may also enter the third extension section 2322, but because the length of the long axis (X-axis) of the charged particle beam 92 is often much larger than the length of the short axis (Y-axis), the value of the second horizontal spacing DX2 will be much larger than the value of the second vertical spacing DY2 in practice. However, since the length of the long axis (X-axis) of the charged particle beam 92 is often much larger than the length of the short axis (Y-axis), the second horizontal spacing DX2 will be much larger than the second vertical spacing DY2 in practice, so the percentage of magnetic lines from the first extension section 2122 entering the second extension section 2132 or the percentage of magnetic lines from the fourth extension section 2332 entering the third extension 2322 is very limited.

Figure 8A:
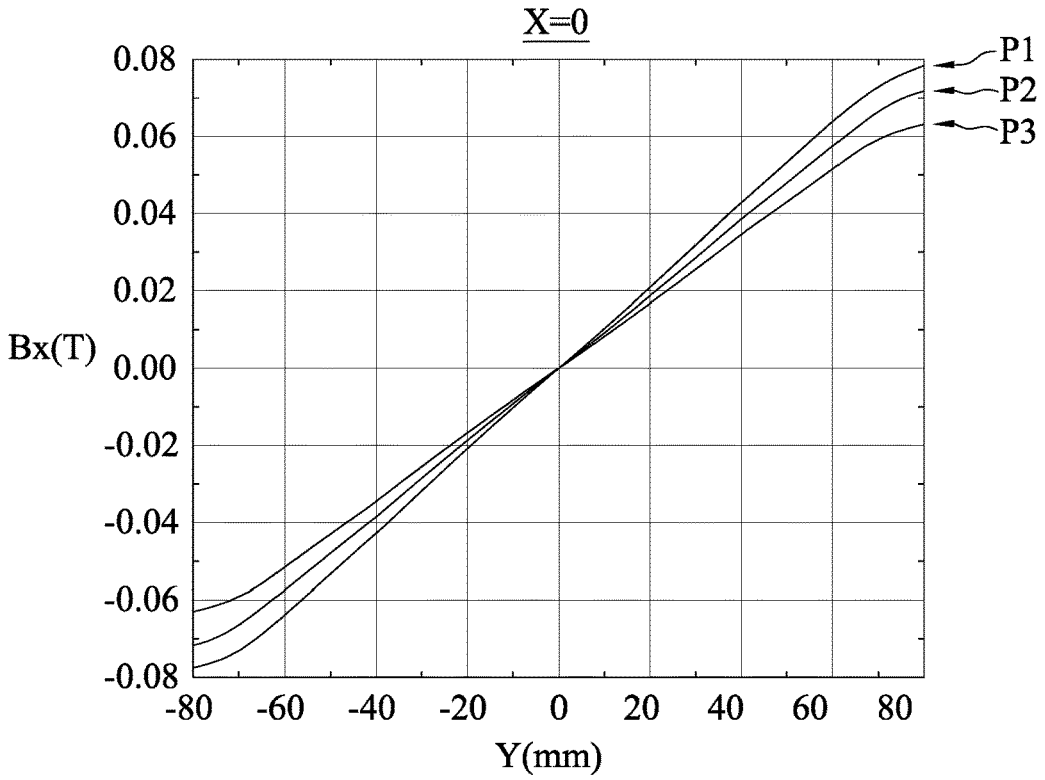
FIG. 8A illustrates a simulation of the gradient magnetic field formed by the hybrid magnet structure of the second embodiment, whereby the coordinates in the center of the field of the gradient magnetic field are (0,0), and the curves represent the trend of the magnetic field Bx with the Y-axis when X=0, and P1~P3 represent the curves obtained by different DX2 values respectively.
Figure 8B:
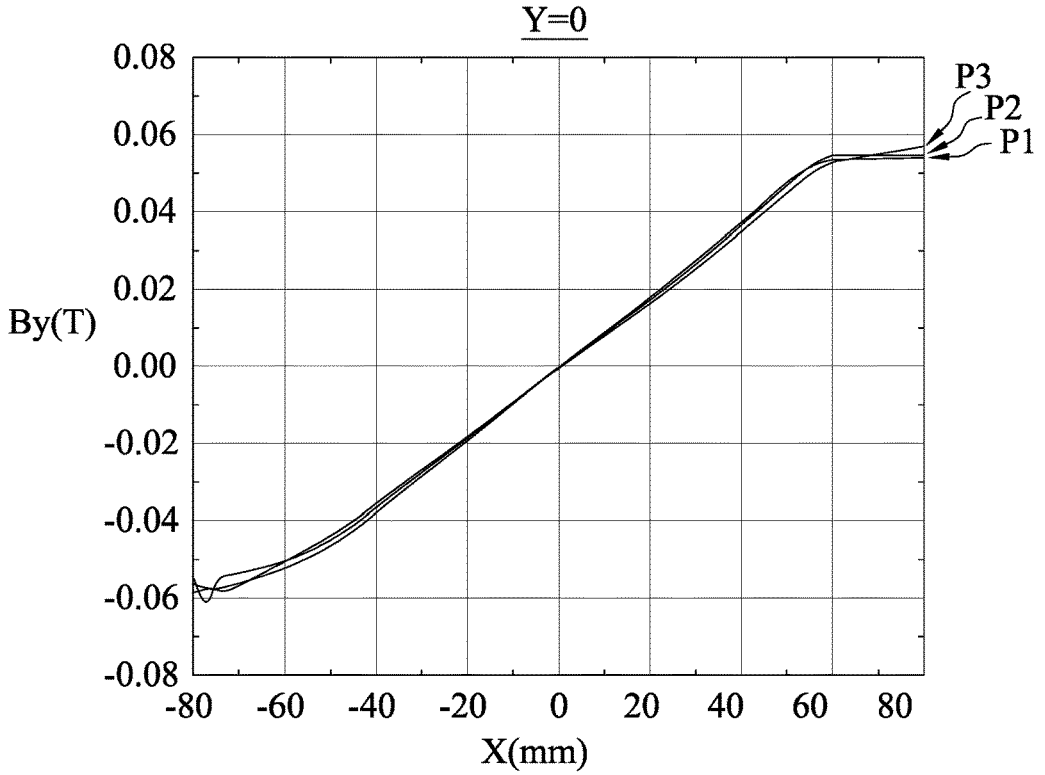
FIG. 8B illustrates the simulation of the gradient magnetic field formed by the hybrid magnet structure of the second embodiment, whereby the coordinates of the center of the gradient magnetic field are (0,0), and the curves represent the trend of the magnetic field By with the change of the X-axis when Y=0, and P1~P3 represent the curves obtained from different DX2 values respectively.

Referring to FIGS. 8A and 8B, the gradient magnetic field is located in the XY plane, and the coordinates of the center of the gradient magnetic field are (0,0), and DY2=DY1.

From FIGS. 8A and 8B, one can see that the magnetic field in the center of the gradient magnetic field is 0, and the magnetic field will gradually become larger as we move away from the center of the gradient magnetic field.

FIGS. 8A and 8B contain three curves in curve P1, curve P2 and curve P3, which represent the simulation results of the magnetic field obtained by varying the second horizontal spacing DX2 for a fixed second vertical spacing DY2. The distance of the second horizontal spacing DX2 between curves P3 is larger than that between curves P2, and the distance of the second horizontal spacing DX2 between curves P2 is larger than that between curves P1. The magnetic field Bx in the X-direction decreases as the second horizontal spacing DX2 becomes larger.

As shown in FIG. 5, in some configurations, the distance between the first extension section 2122 of the first iron core 212 and the third extension section 2322 of the third iron core 232 along the Y-axis is equal to the distance between the second extension section 2132 of the second iron core 213 and the fourth extension section 2332 of the fourth iron core 233 along the Y-axis, and both are of the same second vertical spacing DY2. In addition, the distance between the first extension section 2122 of the first iron core 212 and the second extension section 2132 of the second iron core 213 along the X-axis direction is equal to the distance between the third extension section 2322 of the third core 232 and the fourth extension section 233 of the fourth core 233 along the X-axis direction, and both of them are of the same horizontal spacing DX2. The hybrid magnet structure 2 in this example is used to converge (focus) the charged particle beam 92 in the X-axis direction, so the horizontal spacing DX2 will be larger than the vertical spacing DY2, as well as larger than the width WX.

In some configurations, the outer surface of the first permanent magnet and the second permanent magnet may be covered with a graphite layer having a thickness of about 5 mm, so as to prevent the first permanent magnet and the second permanent magnet from being damaged by direct radiation exposure, and thereby prolong the service life of the first permanent magnet and the second permanent magnet. In addition, the surface of the first permanent magnet and the second permanent magnet can be coated with a layer of titanium nitride with a thickness of about 5 μm to prevent the vacuum of the vacuum chamber from being damaged or contaminated by the gas released from the first permanent magnet and the second permanent magnet due to high temperature during operation.

Also, the above-mentioned first magnetic conductive element and the second magnetic conductive element in some configurations can be located outside the vacuum chamber, thus contributing to the miniaturization of the ion implantation system.

In conclusion, the hybrid magnet structures of the present disclosure controls the magnetic field size of the magnetic poles through the shunting of two magnetic conductive elements. Compared with the conventional method of using high energy-consuming coils, the hybrid magnet structure has at least one of the following advantages: (1) the magnetic field control does not consume a large amount of electricity and has the function of energy saving and carbon reduction, (2) the magnet field leakage is smaller and does not affect the magnetic field strength of the neighboring magnets, (3) it is suitable for particle beams of different energy ranges, (4) it is suitable for vacuum environments, especially ultra-high vacuum, and (5) it provides a compact and miniaturized ion implantation system.

As discussed and illustrated, the hybrid magnet structures 1 and 2 include first dipole magnet assemblies 11 or 21, first permanent magnets 111 and 211, first inner sides 111A and 211A, first outer surfaces 111B and 211B, first N-poles 111N and 211N, first S-poles 111S and 211S, first iron cores 112 and 212, first covering sections 1121 and 2121, first extension sections 1122 and 2122, second iron cores 113 and 213, second covering sections 1131 and 2131, second extension sections 1132 and 2132, first magnetic conductivity elements 114 and 214, pitches 114G and 214G, second dipole magnet assemblies 13 and 23, second permanent magnets 131 and 231, second inner surfaces 131A and 231A, second outer surfaces 131B and 231B, second N-poles 131N and 231N, second S-poles 131S and 231S, third iron cores 132 and 232, third covering sections 1321 and 2321, third extension sections 1322 and 2322, fourth iron cores 133 and 233, fourth covering sections 1331 and 2331, fourth extension sections 1332 and 2332, second conductive elements 134 and 234, gaps 134G and 234G; charged particle beams 90 and 92, horizontal spacings DX1 and DX2, vertical spacings DY1 and DY2, and width WX.

Although the present disclosure has been disclosed by way of embodiment as above, it is not intended to limit the present disclosure. Any person with ordinary knowledge in the field of the technology to which it belongs may, without departing from the spirit and scope of the present disclosure, make some modifications and embellishments, so that the scope of protection of the present disclosure shall be subject to the true scope of the present disclosure.

What is claimed is:

1. A hybrid magnet structure for focusing a charged particle beam moving in the Z-axis direction, comprising:

a first dipole magnet assembly disposed in the XY plane, the first dipole magnet assembly comprising:

a first permanent magnet having a first N-pole, a first S-pole, a first inner surface and a first outer surface opposite to the first inner surface, the first N-pole and the first S-pole being configured in a linear direction parallel to the X-axis, the first inner surface and the first outer surface being located at the first N-pole and the first S-pole; the first inner surface and the first outer surface being located between the first N-pole and the first S-pole, and the first inner surface being configured to face the path of motion of the charged particle beam;

a first iron core having a first covering section and a first extending section connected therewith, the first covering section covering the first N-pole, and the first extending section extending from the first covering section and projecting from the first inner surface;

a second iron core having a second covering section and a second extension section connected therewith, the second covering section covering the first S-pole, and the second extension section extending from the second covering section and projecting from the first inner surface; and a first magnetic conductive element movably disposed on the first outer surface of the first permanent magnet; and a second dipole magnet assembly, co-planar with the first dipole magnet assembly, comprising:

a second permanent magnet having a second N-pole, a second S-pole, a second inner side and a second outer side opposite the second inner side, with the second N-pole and the second S-pole configured in another linear direction parallel to the X-axis, the second inner side and the second outer side positioned between the second N-pole and the second S-pole, the second inner side configured to face the path of motion of the charged particle beam and toward the first inner side of the first permanent magnet, the second permanent magnet having a second N-pole, a second S-pole, a second inner side and a second outer side opposite the second inner side, and the second inner side being configured to face the path of motion of the charged particle beam and toward the first inner side of the first permanent magnet;

a third iron core having a third covering section and a third extension section connected therewith, the third covering section covering the second S-pole, and the third extension section extending from the third covering section and projecting from the second inner surface, with the third extension section and the first extension section configured in a linear direction parallel to the Y-axis; and a fourth iron core having a fourth covering section and a fourth extension section connected therewith, the fourth covering section covering the second N-pole, and the fourth extension section extending from the fourth covering section and projecting from the second inner surface, with the fourth extension section and the second extension section configured in another linear direction parallel to the Y-axis; and a second magnetic conductive element movably disposed on the second outer side of the second permanent magnet.

2. The hybrid magnet structure according to claim 1, wherein a first distance between the first extension section and the third extension section along the Y-axis is equal to a second distance between the second extension section and the fourth extension section along the Y-axis.

3. The hybrid magnet structure according to claim 2, wherein a third distance between the first extension section and the second extension section along the X-axis is equal to a fourth distance between the third extension section and the fourth extension section along the X-axis.

4. The hybrid magnet structure according to claim 3, wherein the first extension section and the third extended section have a first vertical spacing DY1 along the Y-axis, the second extension section and the fourth extension section also have the first vertical spacing DY1 along the Y-axis, the first extension section and the second extension section have a first horizontal spacing DX1 along the X-axis, the third extension section and the fourth extension section also have the first horizontal spacing DX1 along the X-axis, and the first vertical spacing DY1 is greater than the first horizontal spacing DX1.

5. The hybrid magnet structure according to claim 4, wherein the first permanent magnet has a width WX along the X-axis, the second permanent magnet has the width WX along the X-axis, and the first horizontal spacing DX1 is less than the width WX.

6. The hybrid magnet structure according to claim 1, wherein the first extension section and the third extension section have a second vertical spacing DY2 along the Y-axis direction, the second extension section and the fourth extension section have the second vertical spacing DY2 along the Y-axis direction, the first extension section and the second extension section have a second horizontal spacing DX2 along the X-axis direction, and the second vertical spacing DY2 being smaller than the second horizontal spacing DX2.

7. The hybrid magnet structure according to claim 6, wherein the first permanent magnet has a width WX along the X-axis, the second permanent magnet has the width WX along the X-axis, and the second horizontal spacing DX2 is greater than the width WX.

8. The hybrid magnet structure according to claim 1, wherein the first permanent magnet and the second permanent magnet are coated with a graphite layer on an outer surface of the first permanent magnet.

9. The hybrid magnet structure according to claim 1, wherein the first permanent magnet and the second permanent magnet are coated with a titanium nitride layer on an outer surface of the first permanent magnet.

* * * * *